United States Patent [19]

Gamus et al.

[11] 4,056,277

[45] Nov. 1, 1977

[54] ELECTRIC STRIKE

[75] Inventors: Abraham Gamus, Chomeday; Zoran Knecevic, Montreal, both of Canada

[73] Assignee: Unican Security Systems, Ltd., Montreal, Canada

[21] Appl. No.: 729,647

[22] Filed: Oct. 5, 1976

[51] Int. Cl.[2] ..... E05C 19/16

[52] U.S. Cl. ..... 292/341.16; 292/DIG. 49; 292/346

[58] Field of Search ..... 292/341.16, 341.17, 292/201, 144, 346, 252, DIG. 49

[56] References Cited

U.S. PATENT DOCUMENTS

| | | | |
|---|---|---|---|
| 1,383,269 | 6/1921 | Fienberg et al. | 292/341.16 |
| 1,447,148 | 2/1923 | Peterson | 292/DIG. 49 |
| 1,471,455 | 10/1923 | Ernst | 292/341.16 |
| 3,083,562 | 4/1963 | Weizer | 292/341.16 X |
| 3,553,984 | 1/1971 | Grumbach | 292/341.15 X |

*Primary Examiner*—Richard E. Moore

*Attorney, Agent, or Firm*—Ira Milton Jones & Associates

[57] ABSTRACT

An electric strike type door lock in which the strike tongue is releasably held in its latch bolt securing position by a ball seated in a bore in a wall of the housing in which the strike tongue is mounted. Toggle linkage holds the ball in an operative position projecting from the mouth of the bore and into a pocket in the adjacent surface of the strike tongue, when the toggle linkage is in an extended condition with its knee joint slightly across dead center. A low powered solenoid operatively connected with the knee joint of the toggle, initiates collapse of the toggle and thereby enables the ball to be expelled from the pocket in the strike tongue by door opening force transmitted through the latch bolt onto the strike tongue.

15 Claims, 7 Drawing Figures

ELECTRIC STRIKE

BACKGROUND OF THE INVENTION

This invention is directed to door locking devices and, more particularly, to electromagnetically controlled door locks that are actuatable from a remote location. Such locks, known generally as "electric strikes," are commonly employed for controlling access to hotel, office and apartment buildings from various remote locations throughout the building.

A common denominator of all electric strikes is a latch bolt keeper or strike tongue that is movable from an operative latch bolt securing position to an inoperative latch bolt releasing position. A retractable stop member engages the strike tongue and holds it in its latch bolt securing position. Hence upon retraction of the stop member, which is effected by a remotely controlled solenoid, the strike tongue can be moved out of its operative position by opening force applied to the door.

In prior electric strikes the manner in which the retractable stop member held the strike tongue in its operative position greatly resisted retraction of the stop member and often prevented it if opening force was applied to the door simultaneously with actuation of the solenoid to unlock the door. As a result, the door would not open. This unfortunate and obviously objectionable consequence resulted from the fact that the door opening force applied by the hopeful entrant and transmitted through the latch bolt and the movable strike tongue, to the stop member was often sufficient to override the solenoid-produced retracting force.

One solution to this problem of a thus jammed or restrained strike tongue is to utilize a solenoid having sufficient capacity to generate enough power to overcome the restraining force exerted against the stop member in consequence of door opening force applied simultaneously with energization of the solenoid. But, a solenoid strong enough to do this is expensive and costly to operate.

Another disadvantage of some of the electric strikes heretofore available is the ease with which they could be defeated by insertion of a thin blade-like instrument between the movable strike tongue and its stop member, or by striking the door frame at the location of the strike tongue with a sharp blow to jar the solenoid and thereby cause it to retract the stop member.

A solution to the aforesaid problems heretofore proposed was to maintain the stop member in its projected strike tongue securing position by a continuously energized solenoid powerful enough to prevent release of the strike tongue by the insertion of a blade-like instrument between the movable strike tongue and its stop member, by striking the door frame with a sharp blow or by the application of relatively strong lock defeating forces to the door. Obviously, that manner of assuring the desired security demands an expensive solenoid requiring continuously applied power. Moreover, locks having solenoids in a continuously energized state tend to be noisy and, of course would be defeated by a power interruption.

OBJECTS OF THE INVENTION

There is need therefore for a simpler, inexpensive electric strike in which the stop member cannot be pried away from the strike tongue, by a tampering intruder, but yet is easily and reliably disengageable therefrom by actuation of an inexpensive, low-powered solenoid, even when externally applied forces jam the tongue against the stop member.

Hence a principal objective of the present invention is to provide an electrically actuatable door strike which does not "freeze" or jam in a latch-locking position when external forces are applied transversely to its latch bolt.

A further object is to provide an electric strike of high quality construction and high level of security despite its relatively low production cost and its low powered solenoid.

Before proceeding with the description of the invention, it would be well to point out that in all electrically operated strike locking mechanisms, the latch bolt, when in its projected door locking condition, cannot be retracted from the exterior of the door except through use of a proper key, although it can be retracted by an inside knob and also cammed to its retracted position by engagement thereof with the strike tongue face during closure of the door. Once the door is fully closed, it can be opened only by retraction of the latch bolt in one of the aforesaid ways or by actuation of its solenoid controlled mechanism to release the keeper or strike tongue from its operative position.

In the instant invention a toggle linkage assembly acting through the stop member restrains the strike tongue against displacement from its operative latch bolt locking position, when the toggle linkage is in its extended position. Thus for the door to be unlocked by release of the strike tongue, it is necessary that the toggle linkage be collapsed. This can only be done by a force resulting from energization of the solenoid; but a significant feature of the invention is that the solenoid merely initiates collapse of the toggle. Complete collapse of the toggle linkage results from the door opening-force being applied by a legitimate entrant and transmitted through the projected latch bolt against the released strike tongue.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

SUMMARY OF THE INVENTION

Figure 1:
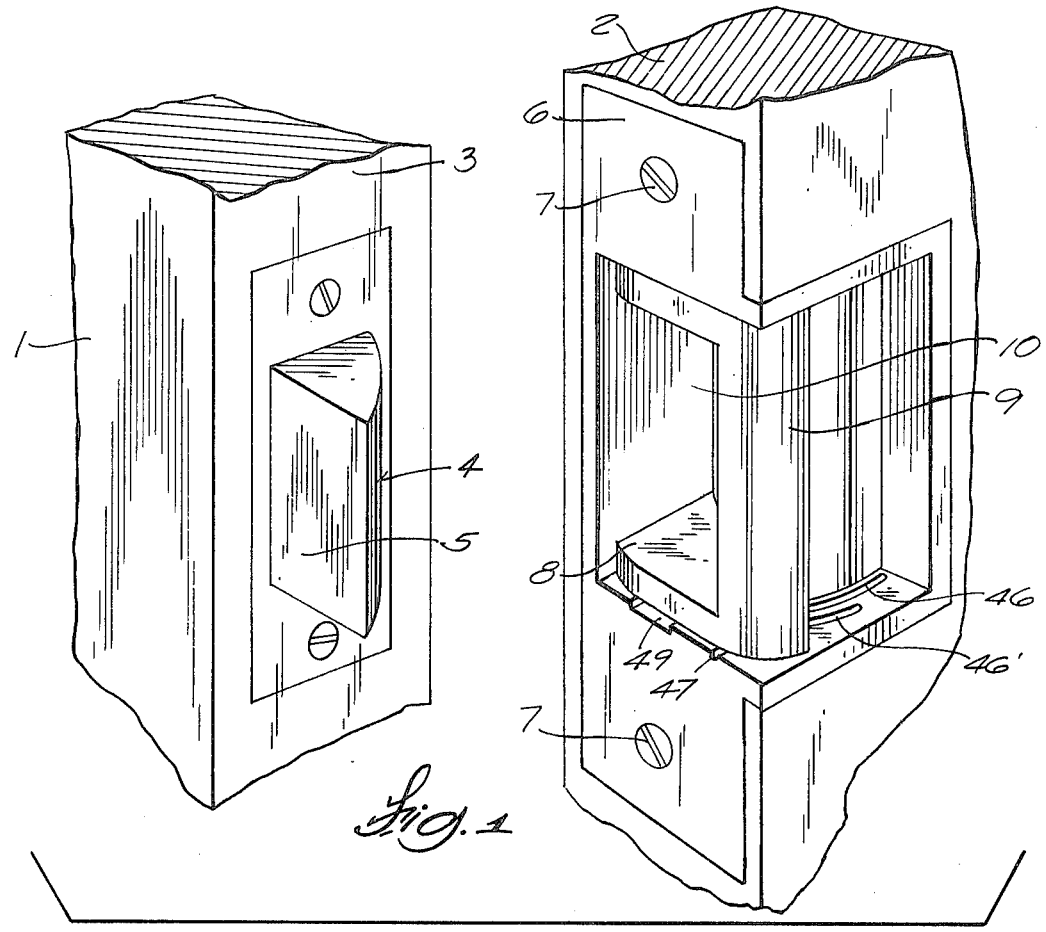
FIG. 1 is a perspective view of a segment of a door and an adjacent portion of its frame, equipped with the door locking mechanism of this invention.
Figure 4:
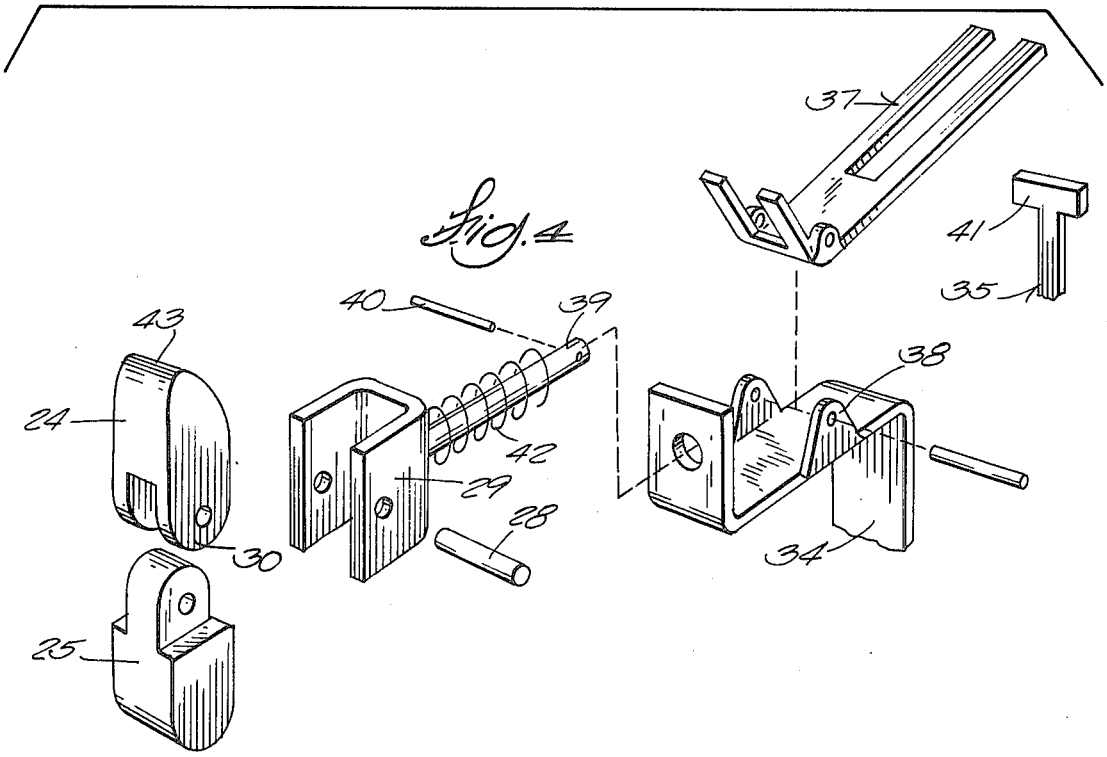
FIG. 4 is an exploded perspective view of the toggle linkage and mechanism through which energization of the solenoid initiates collapse of the toggle linkage.

As will be more fully described hereinafter, the invention resides in the discovery that the desired security and economy in production costs of a door lock can be attained by mounting the strike tongue of the lock in a cavity formed in a housing that is secured in the door frame, for rotation between operative latch bolt securing and inoperative latch bolt releasing positions, during which rotation contiguous surfaces of the housing cavity and the strike tongue slide across one another so that projection across the interface between said contiguous surfaces of a stop member mounted in the housing into a socket in the strike tongue when the latter is in its operative position, locks a closed door against unauthorized opening and, by providing the housing in which the strike tongue is located with a passage leading from its cavity to a mouth that opens to the interface between said contiguous surfaces at a point in line with said socket in the strike tongue when the latter is in its operative position, and with means providing a fulcrum substantially in line with and remote from said passage and by further providing a toggle linkage having inner and outer legs pivotally connected by a knee joint, said toggle linkage being located in said cavity of the housing with the extremity of its inner leg supportingly engaged with said fulcrum and the extremity of its outer leg adjacent to said passage and movable towards and from the mouth thereof as the toggle linkage is respectively straightened and collapsed; means at the extremity of the outer leg of the toggle linkage to project across the interface between said contiguous surfaces into the socket in the strike tongue when the toggle linkage is in a substantially straightened extended condition; biasing means yieldingly urging the toggle linkage towards its straightened condition and in one direction beyond its dead center condition; so shaping the interengaging surfaces of said socket and said means at the extremity of the outer leg of the toggle linkage as to provide a wedging action that translates torque applied to the strike tongue by opening force exerted upon the closed door into toggle collapsing force; and providing means defining a stop to support said toggle linkage in said slightly beyond dead center condition and thereby resist any collapsing force applied to the toggle linkage by the aforesaid wedging action; and remotely actuatable means operatively connected with the knee joint of the toggle linkage for moving the same across dead center in the direction opposite to that in which said biasing means urges the same, to thereby initiate collapse of the toggle linkage.

DETAILED DESCRIPTION

Referring to the accompanying drawings, the numerals 1 and 2 identify adjacent portions of a door and the doorway closed thereby. The free edge portion 3 of the door has a conventional latch bolt 4 retractably projecting therefrom, the flat face 5 of which is oriented in the direction in which the door swings open. When the door is closed, the latch bolt engages and coacts with the movable strike tongue assembly of the lock to hold the door closed. This assembly comprises a housing 6 which is seated in an appropriate cavity in the adjacent edge portion of the door frame, where it is secured by screws 7. The housing 6 has a cavity 8 which encases the movable keeper or strike tongue 9 of the assembly and, as is customary, this keeper or strike tongue has a cavity 10 to receive the latch bolt as the door is closed.

The keeper or strike tongue is rotatably mounted in its cavity by a shaft 11 which extends longitudinally through the strike tongue and has its end portions projecting beyond its bottom and top faces 12 and 13 to be journalled in the adjacent housing walls 14 and 15. A torsion spring 16 encircling the shaft 11 and seated in a cavity 17 located in the bottom portion of the strike tongue reacts between the strike tongue and the housing wall 14 ro yieldingly urge the strike tongue to its latch bolt holding position.

The essence of this invention resides in the manner in which the strike tongue is releasably secured in its latch bolt holding position. For this purpose, a stop member 18 - which may be a conventional ball bearing — is seated in a bore 19 in the bottom wall 14 of the housing cavity 8. The low end of this bore opens to a chamber 20 formed in housing 6 beneath the cavity 8 through a constriction 21 which keeps the ball 18 from dropping through the bottom of the bore.

When the strike tongue is in its latch bolt holding position, a socket or pocket 22 formed in its bottom face 12 is positioned to receive the ball 18 upon projection thereof from the upper open end of the bore 19. When thus projected, the ball extends across the interface between the strike tongue bottom 12 and the lower wall 14 of the housing cavity 8 and thereby retains the strike tongue in its latch bolt holding position.

The position of the ball in the bore 19 is controlled by a toggle linkage assembly 23 located within the chamber 20. This toggle assembly comprises upper and lower legs 24 and 25, respectively, connected by a knee joint assembly 26. The outer end of the lower leg 25 is rockably seated in a recess 27 in the bottom wall of the chamber 20 to provide a fixed fulcrum for the toggle at an elevation so related to the length of the toggle legs that the outer free end of the upper leg 24 projects into the bore 19 and supports the ball 18 at an elevation determined by the condition of the toggle linkage.

The knee joint assembly 26 of the toggle linkage includes a pin 28 by which the legs of the toggle are pivotally connected to one another and to a U-shaped saddle 29.

Figure 2:
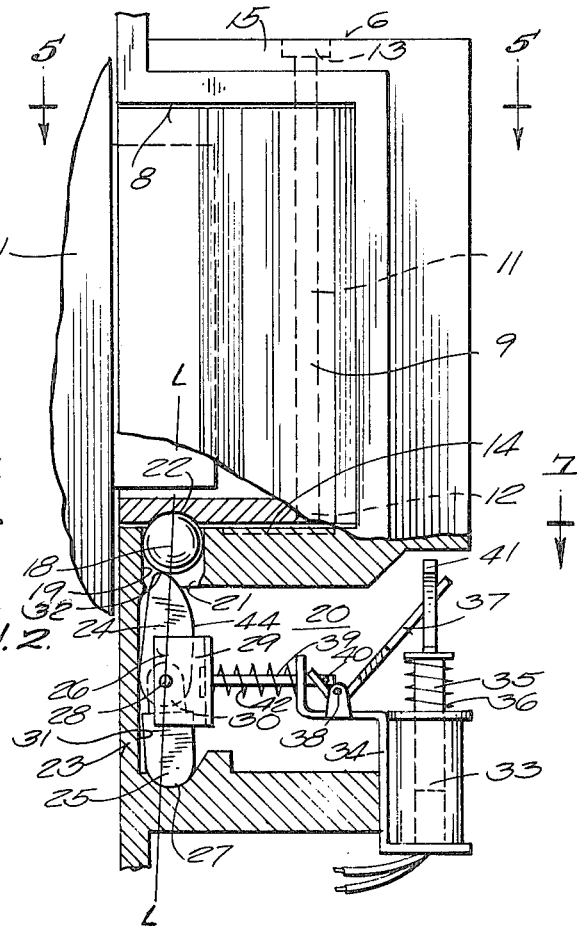
FIG. 2 is a side elevational view of the mechanism in its engaged or locked condition, parts thereof being broken away and shown in section and no part of the door frame being shown.
Figure 3:
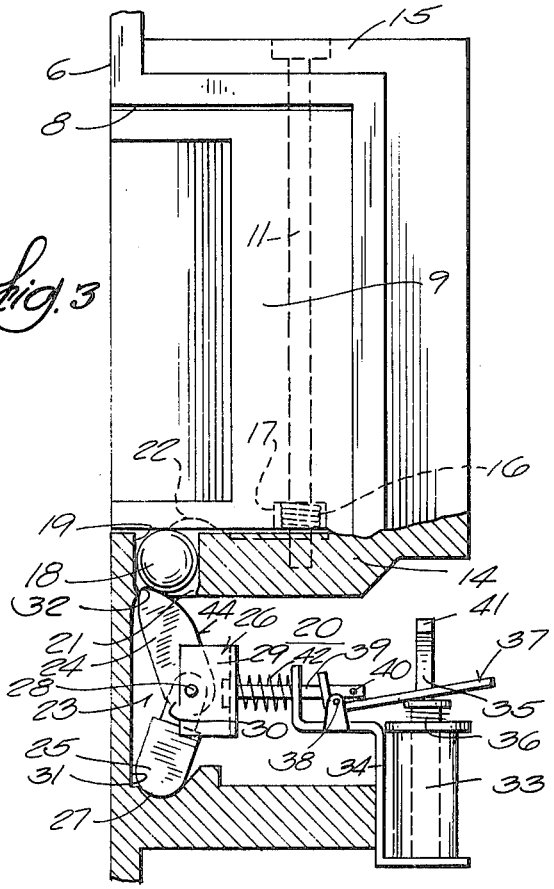
FIG. 3 is a view similar to FIG. 2, but showing the mechanism in its unlocked condition.
Figure 5:
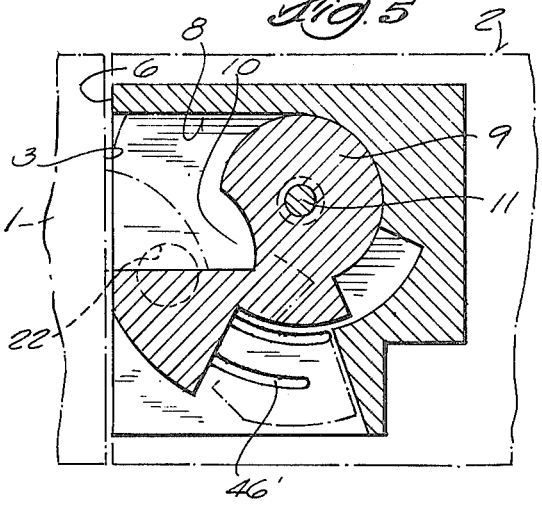
FIG. 5 is a cross-sectional view through FIG. 2 on the plane of line 5—5.

In the collapsed condition of the toggle assembly shown in FIG. 3, the ball occupies a position entirely beneath the aforesaid interface thereby releasing the strike tongue for movement to its inoperative latch bolt releasing position, whereas in the extended condition of the toggle illustrated in FIG. 2, the ball is projected across the interface and into the pocket or cavity 22 to hold the strike tongue in its operative position.

It is important to observe that in the extended condition of the toggle assembly, the axis of its knee joint is slightly across dead-center and the lower end 30 of upper leg 24 bears against the adjacent wall 31 of chamber 20. Thus any downward force on the toggle linkage originating from attempts to displace the ball from the pocket 22 — as by torque applied to the strike tongue 9 through the latch bolt 4 — will force the leg end 30 even more tightly against the wall 31. Accordingly, any such attempts to defeat the lock would entail the application of force so intense that some other part of the mechanism — as, for instance, the latch bolt itself — would be destroyed before the toggle linkage would collapse.

Legitimate collapse of the toggle linkage assembly to allow descent of the ball and unlocking movement of the strike tongue 9, is effected by movement of the saddle 29 in the direction normal to the linkage center-line and away from the housing wall 31. Since the axis of the knee joint is only slightly across dead-center when the toggle is in its extended condition, only a small movement of the knee joint in the opposite direction is required to carry the axis of the knee joint across dead center and thereby initiate collapse of the toggle. Once the axis of the knee joint is thus moved across dead-center, the toggle linkage can no longer prevent downward displacement of the ball 18 by force supplied by a person opening the unlocked door, and transmitted to the ball by the wedging action of the sides of the pocket 22 as the latch bolt — moving with the door — rocks the strike tongue about its axis of rotation.

Although the "over-center" condition of the toggle linkage 23, and the support of its knee joint by the wall 31, when the strike tongue is in its locked condition, securely prevents unauthorized collapse of the toggle and consequent release of the strike tongue, only a relatively light force is required to pull the knee joint of the toggle away from the wall 31 and across dead-center to initiate collapse of the toggle. That light force can be supplied by a low-powered inexpensive solenoid.

By contrast, withdrawal of the strike tongue holding means of conventional electric strikes — which typically comprises a pin-and-recess arrangement, or a mechanically cumbersome trip lever mechanism — requires a fairly large, powerful solenoid, and, even then, cannot be withdrawn to unlock the door when door-opening force is applied at the moment the solenoid is energized.

The present invention not only overcomes the problem of jamming when such force is applied to the door, but actually utilizes that force to advantage, since the instant the knee joint of the toggle linkage crosses dead-center to initiate collapse of the toggle linkage, the camming action at the interface of the convex-concave spherical surfaces of the ball 18 and the pocket 22 coacts with the door-opening force to complete collapse of the toggle and thus precludes the objectionable jamming that has characterized conventional electric strikes. In addition, it should be noted that all bearing surfaces at the contact points between the several relatively movable parts of the strike holding and releasing means — specifically, the ridge 32 on the outer end of the upper toggle leg 24, the pin 28 connecting the two toggle legs with the saddle 29 and the rocking engagement of the bottom leg 25 in the recess 27 — are rounded with respect to one another to minimize friction and to facilitate sliding movement therebetween.

There is, therefore, minimal frictional resistance to movement of the toggle linkage knee joint over the short distance across dead-center needed to initiate collapse of the toggle, and — once this initial movement is accomplished — the heretofore potentially jamming force exerted against the strike tongue and transmitted to the stop member, actually completes collapse of the toggle linkage by urging — rather than hindering — movement of the stop member to its strike tongue releasing position.

In keeping with the objectives of this invention, the toggle linkage collapse-initiating force is supplied by a low-powered solenoid 33 mounted with its axis vertical on a bracket 34 that is fixed in housing 6. The armature 35 of the solenoid is biased upwardly by a light spring 36 which is easily overcome by energization of the solenoid. Upon such energization, the resulting downward motion of the armature, acting through motin-transmitting and translating means interposed between the armature and the knee joint of the toggle linkage, snaps the knee joint across dead-center to initiate collapse of the toggle linkage.

In the embodiment of the invention illustrated, this motion-transmitting means comprises a long and short armed bell crank 37 pivotally mounted to rock about a fixed fulcrum 38 on the bracket 34. The short arm of the bell crank is connected with the saddle 29 through a stem 39 fixedly projecting therefrom, and the long arm thereof is operatively connected with the armature 35. Although these connections can take any suitable form, in the present case the arms of the bell crank are bifurcated to respectively embrace the stem 39 and the armature and to collide with a crosspin 40 in the stem 39 and a crossbar 41 at the outer end of the armature.

In the locked condition of the mechanism, a spring 42 reacting between the saddle 29 and the bracket 34 holds the knee joint of the toggle slightly beyond dead-center, with the toggle extended, and — by virtue of the engagement of the short arm of the bell crank with the crossbar 41 — this spring also holds the bell crank 37 in the position shown in FIG. 2. Hence the instant the bell crank is rocked from that position in the clockwise direction, the knee joint of the toggle is moved across dead-center to initiate collapse.

Downward motion of the armature 35 to its "home" position upon energization of the solenoid, imparts that rocking motion to the bell crank by virtue of the collision of the crossbar 41 with the long arm of the bell crank. However, collision of the crossbar with the long arm of the bell crank does not occur until the armature has travelled a distance towards its "home" position. The inertia of the thus relatively freely moving armature (only the light spring 36 resisting it), plus the increased magnetic pull that exists as the armature approaches its home position, assures sufficient force to initiate collapse of the toggle linkage.

Once collapse of the toggle is thus initiated, the short arm of the bell crank disengages itself from the crossbar 41, so that the only resistance to complete collapse of the toggle linkage is that offered by the spring 42 which yields readily to the force resulting from the camming action of the bell 18 being forced out of the recess or pocket 22 by the opening force applied to the door.

Upon closure of the door, the strike tongue is returned to its operative position by the torsion spring 16 mounted on the strike tongue pivot shaft 11, and at that time the spring 42 extends the toggle and projects the ball 18 into the pocket 22.

Since the electric strike of this invention employs a solenoid of very low power, the outwardly facing end or extremity of the upper leg 24 of the toggle which engages the ball 18, is so shaped that motion of the toggle through dead-center takes place without lifting the ball or forcing it against the strike tongue. To achieve this advantage, the extremity of the leg 24 which forms the ridge 32 is asymmetrically disposed, and lies to one side of a line L—L (FIG. 2) that intersects the axis of the toggle knee joint and the center of the ball 18.

When the toggle linkage is in its substantially straightened extended condition supporting the ball 18 in its strike tongue locking position, the point of contact between the ridge 32 and the ball is spaced from the imaginary line L—L in the direction toward the housing wall 31. Accordingly, as the toggle linkage passes through its straight-line dead-center condition during initiation of its collapse, the point of contact between the ridge 32 and the ball moves away from the interface across which the ball is disposed. The toggle linkage thus passes through dead-center without entailing upward displacement of the ball, with the result that solenoid initiated collapse of the toggle is not at all hindered, even when excessive door-opening force is simultaneously applied.

After the point of contact between the leg 24 and the ball 18 crosses the ridge 32 it moves down the adjacent side wall portion 44 of the leg 24, and since this side wall portion is convexly curved the distance between the point of contact and the axis of the knee joint decreases as collapse of the toggle linkage takes place. The effective length of the outer leg of the toggle linkage is thus correspondingly reduced, with the result that the ball quickly drops below the interface to release the strike tongue as the toggle linkage is collapsed.

The shape of the extremity of the upper leg of the toggle whereby the point of contact between it and the ball lies between the housing wall 31 and the imaginary line L—L when the toggle linkage is in its normal substantially straightened condition, not only has the advantage just described, but also increases the assurance against the possibility of achieving forced displacement of the ball from the socket 22 by the application of externally produced torque on the strike tongue while the toggle linkage is in its extended condition.

Figure 6:
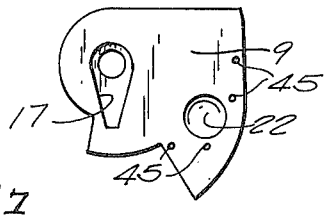
FIG. 6 is a bottom view of the strike tongue.
Figure 7:
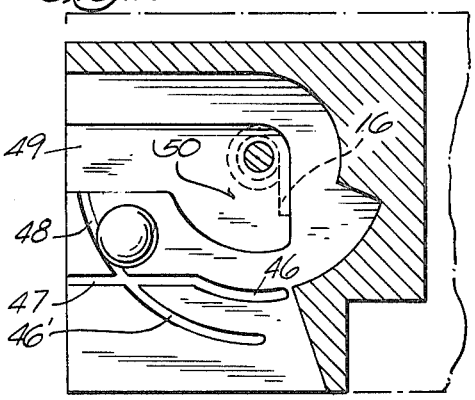
FIG. 7 is a cross sectional view through FIG. 2 on the plane of the line 7—7.

In situations where the door opens outward, the inevitable clearance between the bottom face 12 of the strike tongue and the contiguous surface of the wall 14, i.e. the interface between these surfaces, is accessible from outside the closed door. This would make it possible — unless means are provided to prevent it — to defeat the lock by the insertion of a thin blade like tool into this clearance to force the ball 18 out of the socket 22 the instant a sharp blow is struck against the door frame to momentarily jar the toggle linkage into its collapsed condition. To guard against that possibility, a plurality of small pin-like protrusions 45 project from the bottom face 12 of the strike tongue into grooves 46–46' in the contiguous surface of the wall 14. As shown in FIG. 6, these protrusions are so positioned with respect to the socket 22 that, collectively, they form a barrier between the socket and the entry into the interface, and thus bar access to the ball seated in the socket; and, as shown in FIG. 7, the grooves 46–46' are arcuate and concentric to the axis about which the strike tongue turns. Hence the presence of this barrier does not interfere with rotation of the strike tongue.

Entry of the protrusions into their respective arcuate grooves during assembly of the strike tongue with the housing 6, is accommodated by a straight access groove 47 leading to the groove 46 from the front edge of the wall 14 and by an arcuate access groove 48 leading from the arcuate groove 46' into a relatively wide groove 49. This wide groove leads from the front edge of the wall 14 to a wider shallow recess 50 in which one end of the spring 16 is located, and accommodates that end of the spring during assembly of the strike tongue with the housing.

Although the invention as disclosed herein initiates collapse of the toggle linkage by energization of the solenoid, it should be understood that the invention is equally well adapted to an arrangement wherein collapse of the toggle is initiated by de-energization of the solenoid; in which event release of the strike tongue would automatically occur when power to the solenoid is interrupted.

Those skilled in the art will appreciate that the invention can be embodied in forms other than as herein disclosed for purposes of illustration.

The invention is defined by the following claims.

We claim:

1. In a door lock of the character described wherein a remotely controlled strike tongue in an edge portion of the door frame has a part thereof providing a keeper for an outwardly biased bolt projecting from an edge of the door, wherein said strike tongue is a rigid member located in a cavity in a housing that is secured in said portion of the door frame and is mounted therein for rotation about an axis parallel to said portion of the door frame to and from an operative position to which it is yieldingly biased and in which the part thereof that forms the keeper is engaged with the bolt to hold the door closed, said rigid member and a wall of said housing cavity in which it is located having contiguous surfaces transverse to said axis, that slide across one another during rotation of the rigid member, so that projection across the interface between said contiguous surfaces of a stop member mounted in the housing, into a socket in the rigid member that opens to its respective one of said contiguous surfaces while the rigid member is in its operative position, locks a closed door against unauthorized opening, the improvement which comprises:

A. the housing having
   1. a passage leading from its said cavity to a mouth that opens to the interface between said contiguous surfaces at a point in line with said socket in the strike tongue when the latter is in its operative position, and
   2. means providing a fulcrum substantially in line with and remote from said passage;

B. a toggle linkage having inner and outer legs pivotally connected by a knee joint, said toggle linkage being located in said cavity of the housing with the extremity of its inner leg supportingly engaged with said fulcrum and the extremity of its outer leg adjacent to said passage and movable towards and from the mouth thereof as the toggle linkage is respectively straightened and collapsed;

C. mean at the extremity of the outer leg of the toggle linkage providing said stop member and projecting across the interface between said contiguous surfaces into the socket in said rigid member when the toggle linkage is in a substantially straightened extended condition;

D. biasing means yieldingly urging the toggle linkage towards its straightened condition and in one direction beyond its dead center condition;

E. the interengaging surfaces of said socket and said means at the extremity of the outer leg of the toggle linkage being shaped to provide a wedging action that translates torque applied to said rigid member by opening force exerted upon the closed door into toggle collapsing force;

F. means defining a stop to support said toggle linkage in said slightly beyond dead center condition and thereby resist any collapsing force applied to the toggle linkage by the aforesaid wedging action; and G. remotely actuatable means operatively connected with the knee joint of the toggle linkage for moving the same across dead center in the direction opposite to that in which said biasing means urges the same to thereby initiate collapse of the toggle linkage.

2. The improvement in a door lock defined by claim 1, wherein said means at the extremity of the outer leg of the toggle linkage that provides said stop member is a non-compressible body movably received in said passage and guided thereby for substantially vertical movement to and from a position projecting across said interface, and wherein the outer leg of the toggle linkage engages said non-compressible body, so that upon extension of the toggle linkage said body is projected to said position.

3. The improvement in a door lock defined by claim 2, wherein the interface between said contiguous surfaces is substantially horizontal and located above said cavity in the housing so that the mouth of said passage opens upwardly to the interface, wherein said passage constrains said non-compressible body to substantially vertical movement to and from its position projecting across said interface, and wherein the outer leg of the toggle linkage supports and non-compressible member and upon extension of the toggle linkage, lifts said non-compressible body to its said position.

4. The improvement in a door lock defined by claim 2, wherein said non-compressible body is a ball.

5. The improvement in a door lock defined by claim 3, wherein said ball is a conventional ball bearing.

6. The improvement in a door lock defined by claim 1, wherein said remotely actuatable means comprises an electromagnetic actuator having a solenoid, and a movable armature mechanically biased towards one of its positions and moved to its other position upon energization of the solenoid, and means providing a motion transmitting connection between the armature and the knee joint of the toggle linkage.

7. The improvement in a door lock defined by claim 6, wherein said motion transmitting connection is unidirectional and has a degree of the lost motion so that the armature moves a distance in response to energization of the solenoid before its transmits motion to the knee joint.

8. The improvement in a door lock defined by claim 4, further characterized in that the extremity of the outer leg of the toggle linkage is so shaped that its point of engagement with said ball moves downward during collapse of the toggle linkage even as the toggle linkage approaches its dead center condition, so that initiation of the collapse of the toggle linkage does not entail any upward movement of the ball.

9. The improvement in a door lock defined by claim 8, wherein the shape of the extremity of the outer leg of the toggle linkage is such that throughout the collapse of the toggle linkage its point of contact with the ball moves downward.

10. The improvement in a door lock defined by claim 9, wherein the extremity of the outer leg of the toggle linkage is shaped to form an asymmetrically disposed ridge the apex of which engages the ball when the toggle linkage is in its substantially straightened extended condition, and the point of contact between the extremity of the outer leg and the ball lies to one side of a line intersecting the axis of the knee joint and the center of the ball.

11. The improvement in a door lock defined by claim 10, wherein one side of said asymmetrically disposed ridge engages the ball as the toggle linkage moves from its substantially straightened extended condition towards its collapsed condition, and wherein said one side is convexly curved so that the distance between its point of contact with the ball and the axis of the knee joint decreases as the toggle linkage approaches its collapsed condition.

12. The improvement in a door lock defined by claim 1, further characterized by:

means forming a barrier across said interface between said stop member and the entrance to the interface, to prevent engagement with the stop member of a blade-like tool inserted into the interface.

13. The improvement in a door lock defined by claim 12, wherein said means forming the barrier comprises a plurality of pin-like protrusions projecting from one of the contiguous surfaces of the interface into a groove in the other of said contiguous surfaces.

14. The improvement in a door lock defined by claim 13, wherein said protrusions are on the strike tongue and the groove is in a wall of the cavity in the housing.

15. The improvement in a door lock defined by claim 13, wherein said groove is concentric to the axis about which the strike tongue turns.

* * * * *